US006173128B1

(12) United States Patent
Saber et al.

(10) Patent No.: US 6,173,128 B1
(45) Date of Patent: Jan. 9, 2001

(54) REMANUFACTURING SYSTEM FOR REPLACEABLE MODULES IN A DIGITAL PRINTING APPARATUS

(75) Inventors: Eli S. Saber; Dhirendra C. Damji, both of Webster, NY (US); Arnold G. Leon, Palm Desert, CA (US); Porfirio J. Perez, Walworth, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/383,423

(22) Filed: Aug. 27, 1999

(51) Int. Cl.[7] ..... G03G 15/00
(52) U.S. Cl. ..... 399/24; 399/109
(58) Field of Search ..... 399/24, 109, 10, 399/25, 11, 43

(56) References Cited

U.S. PATENT DOCUMENTS

| | | | | |
|---|---|---|---|---|
| 4,133,477 | * | 1/1979 | Marino et al. | 399/10 |
| 4,586,147 | | 4/1986 | Tadokoro | 364/550 |
| 4,634,258 | | 1/1987 | Tanaka et al. | 355/4 |
| 4,774,544 | | 9/1988 | Tsuchiya et al. | 355/14 C |
| 4,851,875 | * | 7/1989 | Tanimoto | 399/24 |
| 4,961,088 | | 10/1990 | Gilliland et al. | 355/206 |
| 5,021,828 | * | 6/1991 | Yamaguchi et al. | 399/24 |
| 5,049,898 | | 9/1991 | Arthur et al. | 346/1.1 |
| 5,200,779 | * | 4/1993 | Nawata | 399/24 |
| 5,272,503 | | 12/1993 | LeSueur et al. | 355/208 |
| 5,283,613 | | 2/1994 | Midgley, Sr. | 355/203 |
| 5,305,199 | | 4/1994 | LoBiondo et al. | 364/403 |
| 5,489,540 | * | 2/1996 | Nam | 399/110 |
| 5,491,540 | * | 2/1996 | Hirst | 399/110 |
| 5,512,988 | | 4/1996 | Donaldson | 355/260 |
| 5,533,193 | | 7/1996 | Roscoe | 395/183.15 |
| 5,636,032 | | 6/1997 | Springett | 358/296 |
| 5,864,730 | | 1/1999 | Budnik et al. | 399/26 |
| 5,926,666 | * | 7/1999 | Miura et al. | 399/25 |

* cited by examiner

*Primary Examiner*—Quana M. Grainger
(74) *Attorney, Agent, or Firm*—R. Nutter

(57) ABSTRACT

An electrophotographic printing or copying machine includes a functional module which can be readily removed and replaced. The module includes a monitor in the form of an electronically-readable memory, which includes information about how the particular module is to be operated. In a remanufacturing process, certain combinations of codes in the memory are noted to determine whether individual parts in the module should be replaced.

17 Claims, 3 Drawing Sheets

REMANUFACTURING SYSTEM FOR REPLACEABLE MODULES IN A DIGITAL PRINTING APPARATUS

Cross-reference is made to the following US patent application, pending as of the filing hereof, and assigned to the assignee hereof: Ser. No. 08/978,307, filed Nov. 25, 1997, based on a provisional application Ser. No. 60/043,579, filed Apr. 11, 1997.

INCORPORATION BY REFERENCE

The following US patents, assigned to the assignee hereof, are hereby incorporated by reference: U.S. Pat. Nos. 5,533,193 and 5,864,730.

FIELD OF THE INVENTION

The present invention relates to a system for controlling replaceable modules, also known as "customer replaceable units" or CRUs, in a printing apparatus, such as a digital electrophotographic printer/copier.

BACKGROUND OF THE INVENTION

In the office equipment industry, different customers have different requirements as to their business relationship with the manufacturer of the equipment or other service provider. For various reasons, some customers may wish to own their equipment, such as copiers and printers, outright, and take full responsibility for maintaining and servicing the equipment. At the other extreme, some customers may wish to have a "hands off" approach to their equipment, wherein the equipment is leased, and the manufacturer or service provider takes the entire responsibility of keeping the equipment maintained. In such a "hands off" situation, the customer may not even want to know the details about when the equipment is being serviced, and further it is likely that the manufacturer or service provider will want to know fairly far in advance when maintenance is necessary for the equipment, so as to minimize "down time." Other business relationships between the "owning" and "leasing" extremes may be imagined, such as a customer owning the equipment but engaging the manufacturer or service provider to maintain the equipment on a renewable contract basis.

A common trend in the maintenance of office equipment, particularly copiers and printers, is to organize the machine on a modular basis, wherein certain distinct subsystems of a machine are bundled together into modules which can be readily removed from machines and replaced with new modules of the same type. A modular design facilitates a great flexibility in the business relationship with the customer. By providing subsystems in discrete modules, visits from a service representative can be made very short, since all the representative has to do is remove and replace a defective module. Actual repair of the module takes place away at the service provider's premises. Further, some customers may wish to have the ability to buy modules "off the shelf," such as from an office supply store. Indeed, it is possible that a customer may lease the machine and wish to buy a succession of modules as needed. Further, the use of modules, particularly for supply units such as toner bottles, are conducive to recycling activities which are available, and occasionally mandatory, in many countries.

In order to facilitate a variety of business arrangements among manufacturers, service providers, and customers of office equipment such as copiers and printers, it is known to provide these modules with electronically-readable chips which, when the module is installed in a machine, enable the machine to both read information from the memory and also write information, such as a print count, to the module. The present invention is directed to a generalized system for information exchanges between modules and machines in an environment of printers and copiers.

DESCRIPTION OF THE PRIOR ART

U.S. Pat. No. 4,586,147 discloses an electrophotographic printing apparatus having a "history information providing device". The device includes a non-volatile memory for taking out the latest failure information, such as the number of times of paper jam, and the latest maintenance information such as the total number of pages of printed paper and storing this information therein. The information thus stored in the non-volatile memory is accessed by causing the printer to print out the information stored in the non-volatile memory.

U.S. Pat. No. 4,634,258 discloses a color copying machine in which a plurality of toner supplies, each of a different color, can be called upon. There is provided a plurality of counters for counting the number of copies provided with each color toner developer container.

U.S. Pat. No. 4,774,544 discloses an electrophotographic printer in which the number of image forming operations is maintained in an EEPROM within the machine. The EEPROM is used to hold the data in case the machine is turned off.

U.S. Pat. No. 4,961,088 discloses the basic concept of using an electronically-readable memory permanently associated with a replaceable module which can be installed in a digital printer. The embodiment disclosed in this patent enables a printer to check an identification number of the module, to make sure the module is authorized to be installed in the machine, and also enables a count of prints made with the module to be retained in the memory associated with the module.

U.S. Pat. No. 5,049,898 discloses an ink-jet printhead cartridge having a memory element associated therewith. This memory element can store operational characteristics, such as a code indicating the color of ink in the printhead, or the position of the ink-jet orifices on the printhead body. A datum characterizing the amount of ink in the cartridge at any time can be periodically updated to reflect use of ink during printing and can warn the user of an impending exhaustion of ink.

U.S. Pat. No. 5,272,503 discloses a replaceable cartridge for an electrophotographic printer, having a memory device associated therewith. The memory device stores a value which varies as a function of the usage of the cartridge, and this varying value causes a controller in the printing apparatus to adjust a selected operating parameter in accordance with the value, thus maintaining printing quality of the printing machine.

U.S. Pat. No. 5,283,613 discloses a substantially "tamper proof" electronically-readable memory for use in a replaceable print module. A count memory associated with a replaceable module maintains a one-by-one count of prints made with the module. The memory associated with the module further includes a memory which can only be decremented, which serves as a "check" to prevent electronic manipulation of the print count memory.

U.S. Pat. No. 5,491,540 discloses a printer/copier having a plurality of replaceable parts therein. Each replaceable part has a memory chip associated therewith, and, within the total apparatus, the various memory chips are connected in serial fashion by only a single wire.

U.S. Pat. No. 5,512,988 discloses an electrophotographic printing apparatus in which a replaceable cartridge is used to convey developer material to a charged photoreceptor. The cartridge is associated with a programmable memory which is programmed with a reference value reflecting a desired amount of developer material to be developed on the photoreceptor. In operation, the control system of the printer detects an actual amount of developer material developed on the photoreceptor and reads the reference value to determine if a difference exists between the detected actual amount and the reference value. In this way, the performance of the cartridge can be monitored.

U.S. Pat. No. 5,636,032 discloses a system for monitoring the supplies of marking material within an electrophotographic or ink-jet printer. The system calculates a number of pixels being rendered in a present job and calculates an amount of marking material used to render the present job. The system also calculates a total area coverage to date for the marking material cartridge, and determines and displays an expected number of pages that the marking material cartridge can render. The system can also calculate per-page costs of the page currently being printed.

U.S. Pat. No. 5,305,199 discloses a reprographic machine which includes an inventory tracking system for monitoring consumable supplies. Usage data from a plurality of networked machines is supplied to a single tracking system for monitoring inventories of supplies consumed by the network. Automatic or semi-automatic ordering can be provided via a remote interactive communications system.

U.S. Pat. No. 5,533,193 discloses a digital printing apparatus in which data related to given machine events is recorded and a memory associated with the machine. When an event such as a fault or a software crash occurs, a code identifying the malfunction is stored in memory. Periodically, or as a result of certain conditions, the log of resulting fault codes are transferred from a first memory into a second memory, such as a non-volatile memory or a disc. The patent also discloses, at column 7, thereof, certain concepts useful in remote monitoring of a machine performance. For instance, a table can be stored in memory having a code column to identify various components within the machine, and a count column to record the number of actual faults or remote function of that particular component since the last recording period; and a current rate column displaying the rate or ratio of actual failures to the total number of opportunities to fail.

U.S. Pat. No. 5,864,730 discloses a method to diagnose the wear behavior of a photoreceptor belt. A systematic test analysis scheme assesses machine operations from a sensor system and pinpoints parts and components needing replacement. The analysis comprises a first level of tests and is capable of identifying a first level of part failure independent of any other test. A series of second level tests, based on a combination of first level test and other tests, are capable of identifying second and third levels of part failure. Codes are stored and displayed to manifest specific part failures.

SUMMARY OF THE INVENTION

According to the present invention there is provided a method of processing a unit installable in a printing apparatus, the unit including a first part, a second part, and a memory. A set of codes are read out from the memory, a first code relating to at least one of a plurality of fault conditions, and a second code relating to an amount of accumulated use of the unit. The first code and the second code are entered in an algorithm, and it is decided to replace the first part in the unit, based on the first algorithm.

DETAILED DESCRIPTION OF THE INVENTION

Figure 1:
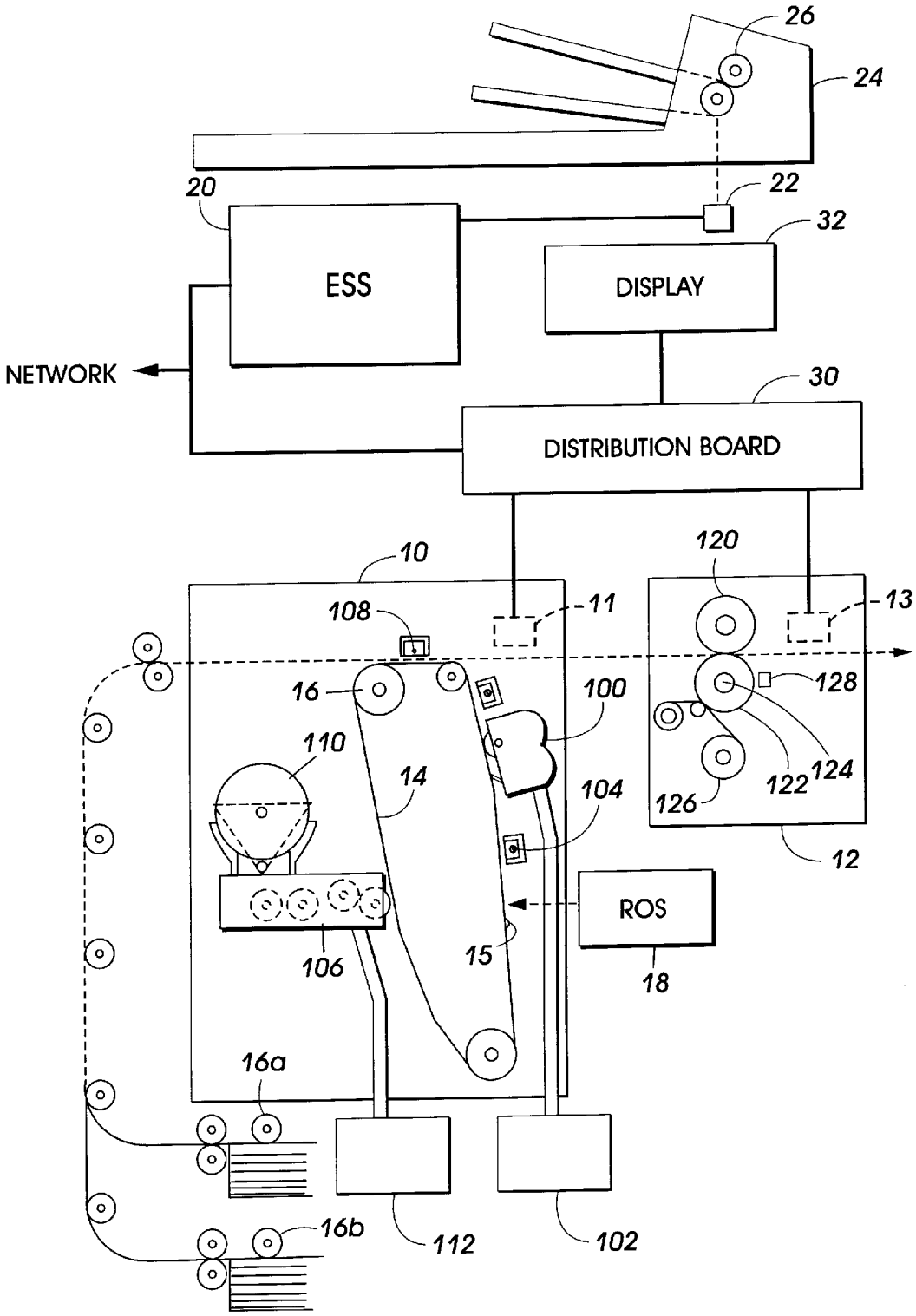
FIG. 1 is a simplified, partially-elevational, partially-schematic view of an electrophotographic printing apparatus in which the aspects of the present invention can be embodied.

FIG. 1 is a simplified partially-elevational, partially-schematic view of an electrophotographic printing apparatus (hereinafter a "machine"), in this case a combination digital copier/printer, in which many of the aspects of the present invention can be embodied. (As used in the claims herein, a "printing apparatus" can apply to any machine that outputs prints in whatever manner, such as a light-lens copier, digital printer, facsimile, or multifunction device, and which can create images electrostatographically, by ink jet, hot-melt, or by any other method.) The two main portions of hardware in the machine include a "xerographic module" indicated as 10, and a "fuser module" indicated as 12. As is familiar in the art of electrostatographic printing, there is contained within xerographic module 10 many of the essential hardware elements required to create desired images electrophotographically. The images are created on the surface of a rotating photoreceptor 14 which is mounted on a set of rollers, as shown. Disposed at various points around the circumference of photoreceptor 14 are a cleaning device generally indicated as 100, which empties into a "toner reclaim bottle" 102, a charging corotron 104 or equivalent device, a developer unit 106, and a transfer corotron 108. Of course, in any particular embodiment of an electrophotographic printer, there may be variations on this general outline, such as additional corotrons, or cleaning devices, or, in the case of a color printer, multiple developer units.

With particular reference to developer unit 106, as is familiar in the art, the unit 106 generally comprises a housing in which a supply of developer (which typically contain toner particles plus carrier particles) which can be supplied to an electrostatic latent image created on the surface of photoreceptor 14 or other charge receptor. Developer unit 106 may be made integral with or separable from xerographic module 10; and in a color-capable embodiment of the invention, there would be provided multiple developer units 106, each unit developing the photoreceptor 14 with a different primary-color toner. A toner bottle 110, which could contain either pure toner or an admixture of carrier particles, continuously or selectably adds toner or developer into the main body of developer unit 106. In one particular embodiment of an electrophotographic printer, there is further supplied a developer receptacle here indicated as 112, which accepts excess developer directly from the housing of development unit 106. In this particular embodiment, the developer receptacle 112 should be distinguished from the toner reclaim bottle 102, which reclaims untransferred toner from cleaning device 100. Thus, in the illustrated embodiment, there are two separate receptacles for used or excess developer and toner.

Turning to fuser module 12, there is included in the present embodiment all of the essential elements of a subsystem for fusing a toner image which has been electrostatically transferred to a sheet by the xerographic module 10. As such, the fuser module 12 includes a pressure roll 120, a heat roll 122 including, at the core thereof, a heat element 124, and a web supply 126, which provides a release agent to the outer surface of heat roll 122 so that paper passing between heat roll 122 and pressure roll 120 does not stick to the heat roll 122. For purposes of the claims herein, either a heat roll or a pressure roll can be considered a "fuser roll." Also typically included in a fusing subsystem is a thermistor such as 128 for monitoring the temperature of a relevant portion of the subsystem.

Paper or other media on which images are desired to be printed are retained on one or more paper stacks. Paper is drawn from the stacks, typically one sheet at a time, by feed rolls such as indicated as 16*a* and 16*b*. When it is desired to print an image on a sheet, a motor (not shown) activates one of the feed rolls 16*a*, 16*b*, depending on what type of sheet is desired, and the drawn sheet is taken from the stack and moved through a paper path, shown by the dot-dash line in the Figure, where it eventually comes into contact with the photoreceptor 14 within xerographic module 10. At the transfer corotron 108, the sheet receives an unfused image, as is known in the art. The sheet then passes further along the paper path through a nip formed between pressure roll 120 and heat roll 124. The fuser subsystem thus causes the toner image to be permanently fixed to the sheet, as is known in the art.

In a digital printing apparatus, whether in the form of a digital printer or in a digital copier, images are created by selectably discharging pixel-sized areas on the surface of photoreceptor 14, immediately after the surface is generally charged such as by corotron 104. Typically, this selective discharging is performed by a raster output scanner (ROS) indicated as 18, which, as is known, includes a modulating laser which reflects a beam off a rotating reflective polygon. Other apparatus for imagewise discharging of the photoreceptor 14, such as an LED bar or lonagraphic head, are also known. The image data operative of the ROS 18 or other apparatus typically generated by what is here called an "electronic subsystem" or ESS, here indicated as 20. (For clarity, the necessary connection between ESS 20 and ROS 18 is not shown.)

The ESS 20 can receive original image data either from a personal computer, or one of several personal computers or other apparatus on a network, or, in the case where the apparatus is being used as a digital copier, via a photosensor bar here indicated as 22. Briefly, the photosensor bar 22 typically includes a linear array of pixel-sized photosensors, on which a sequence of small areas on an original hard-copy image are focused. The photosensors in the array convert the dark and light reflected areas of the original image into electrical signals, which can be compiled and retained by ESS 20, ultimately for reproduction through ROS 18.

If the apparatus is being used in digital copier mode, it is typically desired to supply an original document handler, here generally indicated as 24, to present either or both sides of a sequence of hard-copy original pages to the photosensor bar 22. As is familiarly known, a document handler such as 24 may include any number of rollers, nudgers, etc. one of which is here indicated as 26.

There is further provided within an electrophotographic printing/copying apparatus, what is here called a "distribution board" 30. The distribution board 30 can send or receive messages, as will be described below, through the same network channels as ESS 20, or alternately through a telephone or facsimile line (not shown); alternately, the distribution board 30 can cause messages to be displayed through a display 32, typically in the form of a touch screen disposed on the exterior of the apparatus.

Distribution board 30 interacts with specially-adapted memory devices, here called "customer replaceable unit monitors," or CRUMs, which are associated with one or more customer-replaceable modules within the apparatus. In the illustrated embodiment, xerographic module 10 and fuser module 12 are each designed to be customer-replaceable; i.e., for servicing purposes, the entire module 10 or 12 is simply removed in its entirety from the apparatus, and can then be immediately replaced by another module of the same type. As is familiar in the copier or printer industry, consumers can buy or lease individual modules as needed, and typically replace the modules without any special training. As illustrated, the xerographic module 10 has associated therewith a CRUM 11, while the fuser module 12 has associated therewith a CRUM 13. In a particular embodiment, the xerographic module 10 may further have associated therewith the toner reclaim bottle 102 and the developer receptacle 112, both of which are separable units.

The overall purpose, which will be described at length below, of each CRUM 11 and 13 is to retain information for the particular module about how that module is being used within a machine. Each CRUM 11 or 13 can be considered a small "notepad" on which certain key data is entered and retained, and also periodically updated. Thus, if a particular module 10 or 12 is removed from an apparatus, the information will stay with the module. By reading the data that is retained within a CRUM at a particular time, certain use characteristics of the CRUM can be discovered.

According to a preferred embodiment of the present invention, the CRUM 11 or 13 is basically in the form of a 2K bit serial EEPROM (electrically erasable programmable read only memory). Each CRUM 11, 13 is connected to distribution board 30 using a two-wire serial bus architecture. The non-volatile memory within the CRUM is designed for special applications requiring data storage in a ROM, PROM, and EEPROM mode. There is also preferably included in the device a special protection circuit which can be activated only one time. If this protection circuit is used, the memory content cannot be accessed regardless of the power supply or bus conditions. Each CRUM such as 11 or 13 can serve as both a transmitter and receiver in the synchronous transfer of data with distribution board 30 in accordance with a bus protocol.

The bus connecting distribution board 30 with one of the CRUMS 11 or 13 comprises two bidirectional lines, one for data signals and the other for clock signals. According to a preferred embodiment of the present invention, each data transfer, either data being sent to the CRUM or recordation therein, or being sent out of the CRUM for reading thereof, is initiated with a special "start data transfer" condition, which for example could be defined as a change in the state of the data line from high to low, while the clock is high. Each data transfer, in either direction, is terminated with a stop condition, one example of which can be a change in the state of the data line from low to high while the clock is high. The serial data passing between the distribution board 30 and a CRUM thus exists between the start condition and the stop condition; in a preferred embodiment, the number of data bytes between the two conditions is limited to 8 bytes when updating data within the CRUM, and is not limited when reading data out of the CRUM. Typically, each byte of 8 bits is followed by one acknowledge bit. This acknowledge bit is a low level put on the bus by the CRUM, whereas the distribution board receiving the data will generate an extra acknowledge-related clock pulse. U.S. Pat. No. 4,961,088 gives a general teaching of the hardware required for reading a numerical code from a memory associated with a replaceable module in a digital printing apparatus.

With respect to the different types of data which can be stored in a CRUM such as 11 or 13 to be read or updated by distribution board 30, the following detailed descriptions of each type of data can be applied to either CRUM 11 or CRUM 13, although of course certain types of data will be particularly unique to one type of module, either the xerographic module 10 or the fuser module 12.

Remanufacturing Process

The present invention is directed to a method by which replaceable units, such as xerographic module 10 or the fuser module 12, can be subjected to a fully automated maintenance procedure once such modules 10 or 12 are received at, for instance, a remanufacturing facility. In brief, the present invention relates to reading a set of codes from the EEPROM forming each CRUM 11 or 13, and noting in the CRUM data certain combinations of codes which indicate that specific remanufacturing procedures, particularly replacement of parts, are mandated. Thus, using the present invention, a module such as 10 which has been retrieved from a machine in the field can be sent through an automated assembly-line process, in which various specific parts within the module 10 are replaced. However, replacement of certain parts may possibly be skipped at that particular remanufacturing event, because it can be determined that replacement of certain parts is not necessary. The method of the present invention thus facilitates a minimum-cost remanufacturing procedure for modules such as 10 and 12.

Taking, for example, xerographic module 10 as shown in FIG. 1, three parts within module 10 may be candidates for individual replacement: the photoreceptor belt 14, the cleaning device 100, and the transfer corotron 108. Certain of these parts, such as the photoreceptor belt 14, typically wear at a predictable rate even as part of normal functioning, while other parts, such as transfer corotron 108, may need replacement only when they "break." Another part, such as cleaning device 100, may wear at a predictable rate, but may also be susceptible to partial diminution of effectiveness, mandating replacement even though the particular part may still satisfactorily "work." Thus, various individual parts within a module such as xerographic module 10 may be classifiable as exhibiting predictable wear, catastrophic failure, or a combination of the two. For the fuser module 12, parts which may at various times require replacement include fuser roll 122, pressure roll 120, web 126, and any number of stripper fingers (not shown) on the rolls, which are familiar in the art.

Meanwhile, in the operation of a module such as xerographic module 10 within a copying or printing apparatus, there are certain measurable input and output parameters characterizing the interface between the module, such as xerographic module 10, and the rest of the machine. As is well known in the art, with any xerographic engine such as xerographic module 10, there will be associated any number of feedback control systems to optimize the overall operation of the engine. Further, there may be associated with photoreceptor belt 14 at various locations along the circumference thereof sensors such as toner area coverage sensors (not shown), which optically measure the "darkness" of artificially-generated test patches which are developed by development unit 106; or electrostatic voltmeters (not shown) which measure the electrostatic potential of the surface of photoreceptor belt 14 at predetermined locations. It is also known to use an electrostatic voltmeter to detect the passage thereby of the seam 15 of photoreceptor belt 14, in that when the seam 15 on moving belt 14 moves past a stationary electrostatic voltmeter, the electrostatic voltmeter outputs, as a result, a characteristic profile caused by the passage of seam 15 past it. There may also be associated at various points within xerographic module 10 (and fuser module 12) any number of temperature sensors or thermistors (not shown) at various locations.

The outputs of the various sensors which exist within, or otherwise are associated with, modules such as 10 or 12 relate to feedback control systems which reside within the machine itself, such as within ESS 20 or distribution board 30. The outputs from the various sensors are used by a central control system to cause the central control system to optimize the output of the modules. Typically, these modules are manipulated for optimal performance by varying input parameters, in particular, the applied biases to corotrons such as 104 and 108; the development unit 106; and also the output power from the laser associated with ROS 18. Thus, in the operation of a module such as xerographic module 10, both the outputs from the various sensors and the resulting inputs determined by a control system, such as applied biases and laser power, can be used as tell-tales for determining the condition of various specific parts within the module: for instance if one or more of the biases or laser power is outside of a predetermined "normal operating range," this could be an indication that the photoreceptor 14 is requiring large charges or laser power in order to output satisfactory images, and therefore the photoreceptor 14 should be replaced. Similarly, for example, if charge corotron 104 is requiring a charge outside of a normal range but the ROS 18 is not needing to output a large laser power, this could indicate that the problem is purely with charge corotron 104, and not the photoreceptor 14. Of course, the various combinations of outputs and requirements mandating replacement of various specific parts will depend on the specific design of the printing apparatus.

According to the present invention, by measuring and recording various of these input and output parameters, and also combining these measured parameters with a recording of accumulated use of the module such as stored in CRUM 11, a "profile" of the condition of various specific parts within the module 10 can be recognized, and these profiles can be used to determine whether individual parts within module 10 should be replaced during a particular remanufacturing process. If it is determined, by looking at the "profile," that a particular part is still in satisfactory condition, that part need not be replaced in the remanufacturing process.

According to a specific embodiment of the present invention, CRUM 11 in xerographic module 10 can be adapted to retain therein (so that the information "travels with" the particular module 10 when it is de-installed from a particular machine) certain specific information which is relevant to both the overall operation of the machine, and also which facilitates the method of the present invention.

Figure 2:
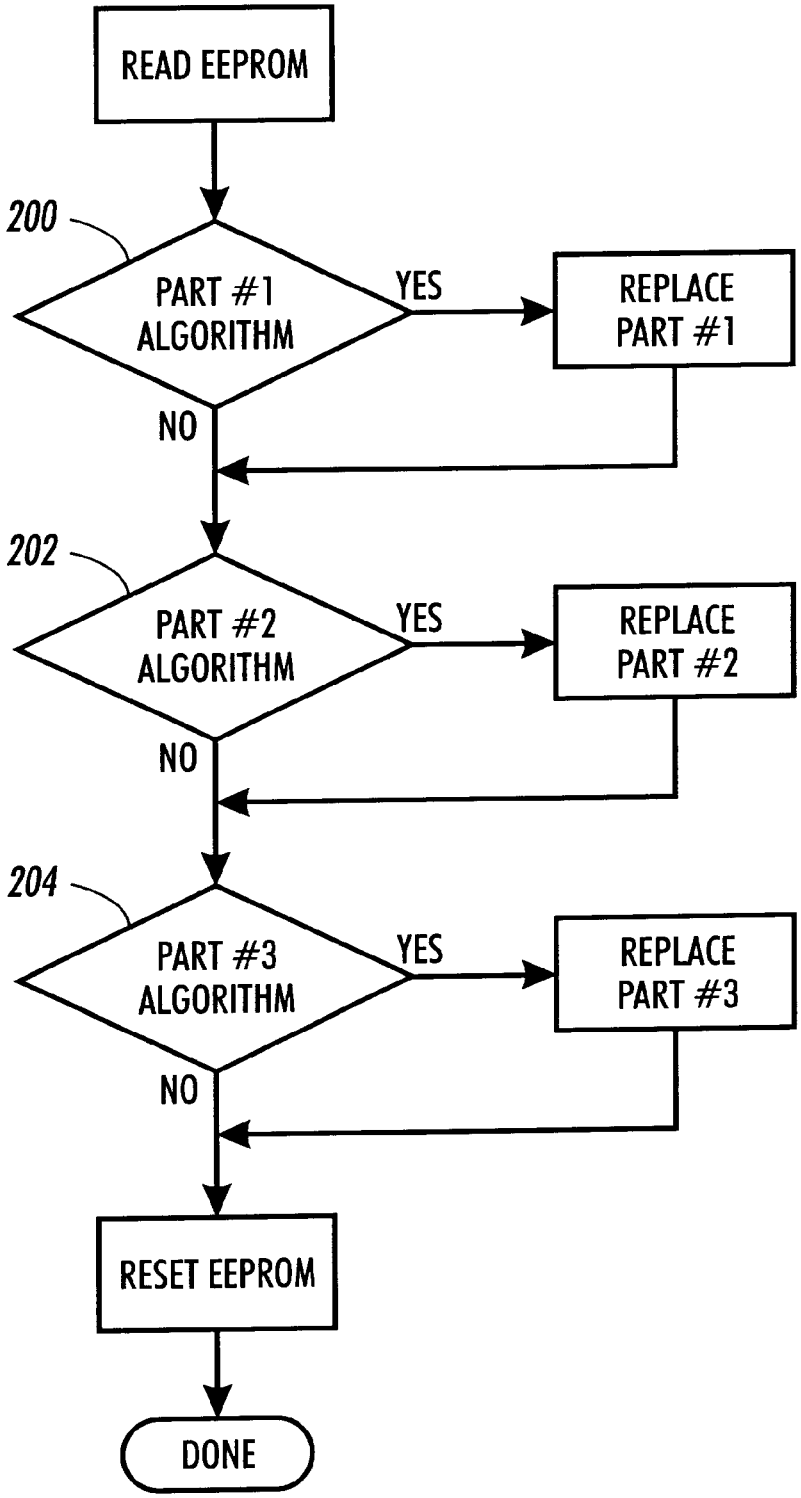
FIG. 2 is a flowchart of an overview of a remanufacturing process for a module installable in a printing apparatus as in FIG. 1.

FIG. 2 is a flow chart showing an overall process for determining the required remanufacturing steps (i.e., replacement of specific parts within the module) for an example module having three possibly-replaceable parts. As shown in the flow chart, the first step is that the EEPROM forming a CRUM such as 11 is read, and the various codes stored therein are applied to a series of algorithms. Each algorithm (which will be described in detail below) relates to a specific possibly-replaceable part within the module.

The algorithms are applied in sequence, and if the algorithm for each part determines that the part should be replaced, the part is replaced; if the algorithm determines that the part need not be replaced, the part is not replaced. Finally, after the algorithms are applied, the EEPROM is reset (any fault codes or error codes are erased, and certain print-count or pixel-count codes are brought to zero). In some embodiments, "resetting" the CRUM may in fact involve replacing the old EEPROM entirely.

Figure 3:
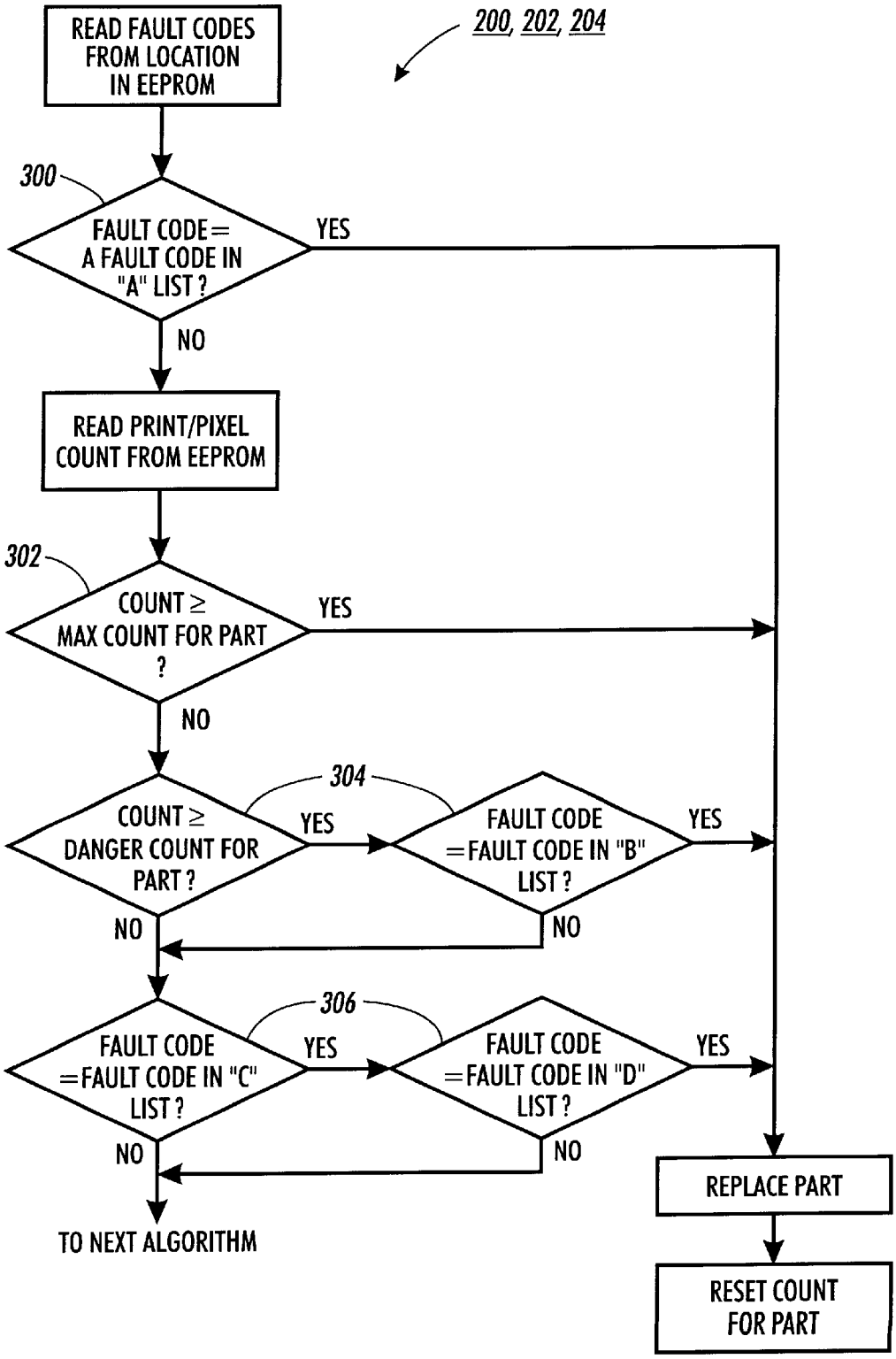
FIG. 3 is a flowchart of a process for deciding whether to replace a particular part in a module installable in a printing apparatus as in FIG. 1.

FIG. 3 is a template flow chart showing a particular algorithm relating to a particular part in the module, as occurs three times in the example of FIG. 2. The flow chart shown in FIG. 3 presumes that the machine, such as in distribution board 30, is capable of placing within CRUM 11 any number of fault codes from a predetermined list of possible fault codes. Each fault code will have a predetermined meaning, and be representative of a specific condition detected within the machine, in particular as the machine interacts with the module 10. As described in the patent application referenced above, once a condition within the machine is detected which is consistent with a particular fault code, the fault code can be loaded by the distribution board 30 into a particular location within the EEPROM or other memory associated with CRUM 11 or 13. These fault codes are preferably also loaded into the CRUM 11 along with the time of the detected fault. According to a preferred embodiment of the present invention, the fault codes need not be representative of an immediately catastrophic condition within the machine or the module, but can be merely "advisory," particularly if the detected condition is indicative of an imminent failure in the future.

Also periodically updated within a CRUM 11 is a running print count or pixel count of pages output or pixels printed with the particular module (this can be done with the CRUM 13 of fuser module 12 as well). There may in fact be several counts retained in the CRUM, such as the print or pixel counts since last remanufacture, along with a grand total of prints or pixels made since original manufacture of the module. According to one embodiment of the present invention, the CRUM can maintain simultaneously pixel counts or print counts (in the claims, this is generalized as a "accumulated use") for each of a plurality of individual parts within the module. Thus, if a first part in the module is replaced and a second part is not replaced, a first print count, tracking the first part, is reset, while a second print count tracking the second part is not reset and allowed to continue accumulating with future use of the module. In this way, the accumulated use of individual parts can be tracked within a single CRUM.

Looking at the various steps within FIG. 3, after a set of fault codes are read from the CRUM, the first step is to determine whether any of the fault codes are, in themselves, consistent with the necessity to replace the particular part to which the algorithm is relevant. As shown at step 300 in FIG. 3, if a fault code read from a CRUM is on what is here called an "A" list of fault codes which are consistent with catastrophic or imminent catastrophic failure, the part in question is simply immediately replaced. If no such fault code is detected, various print or pixel counts can be read from the EEPROM; once again, these counts can be any or all of the counts since manufacture, since last remanufacture, or since the specific part was replaced. If the print or pixel count is above a predetermined lifetime amount for the particular part, such as shown in step 302, then the part is immediately replaced.

The steps indicated as 304 are for determining whether the particular print or pixel count, in combination with a particular detected fault code, mandates replacement of the part. This determination would be useful in situations where a certain fault code is consistent with premature aging of a particular part, even though at the particular moment the part is still satisfactory. Thus, at steps 304, the print or pixel count is checked, and also any fault codes are compared to a list of "advisory" fault codes. The part is then replaced based on the combination of a print or pixel count and fault code, as designed for a particular embodiment. At step 306, a check can be made for a combination of two or more "advisory" fault codes, the combination of which may be determined to mandate replacement of the part. Of course, although the flow chart shows different "B", "C", and "D" lists of fault codes, it will be apparent that the fault codes on different lists can overlap partially or completely among different lists. Once again, if the correct pattern of print or pixel counts and fault codes is not detected, the part is not replaced.

The fault codes can have any predetermined meaning, and can be to varying extents "conclusory." For instance, if one possible fault condition is that laser power is outside a certain acceptable range, one code placed by the distribution board 30 in the CRUM 11 can simply report that laser power is outside a certain range, and let a processing algorithm (such as in FIG. 3) use that basic information for whatever purpose. Alternately, if the laser power is within one predetermined range, and the bias on charge corotron 14 is within another predetermined range, in such a manner that would mandate replacement of photoreceptor 14, the distribution board 30 can either simply report the laser power and corotron bias to the CRUM 11, or else can itself record a code to CRUM 11 which has the meaning "replace the photoreceptor." It is a design question whether the particular decision making algorithms for whether to replace a part should reside in the distribution board 30 (or in some other on-line location, such as on a network), or be done only as part of an off-line remanufacturing process.

With regard to a specific embodiment of the present invention for use in a xerographic module or fuser module of an electrophotographic printing apparatus, some detectable conditions which can be used to place advisory fault codes in the CRUM include the following, alone or in combination:

- electrical feedback characteristic of arcing on a corotron such as 104 or 108
- the feedback system of the machine causing, for whatever reason, the necessary output power of the laser in ROS 18, or the bias on some other part within the module, to be above or below predetermined thresholds; or predetermined combinations of biases on different parts
- a lack of clarity of a seam signature which should be caused by the passage of seam 15 past a voltmeter.

Some conditions which may be detected and cause advisory fault codes to be loaded into the CRUM 13 of fuser module 12 include, alone or in combination:

- any predetermined "dangerous" temperature condition of any thermistor in the module; or a fault relating to a predetermined pattern of thermistor behavior, such as rapid changes in temperature or one thermistor detecting a temperature greatly different from that detected by another thermistor
- torque or feedback (or a pattern thereof) associated with any roller drawing web 126.

U.S. Pat. No. 5,533,193, incorporated by reference above, discloses various techniques for generating fault codes which are associated with individual parts, such as could be found in a CRU such as 10 or 12. In the '193 patent, a memory associated with a machine, may include various columns to accept codes relative to different faults of different individual components. For example, within a memory, there is a code column to identify various components, a count column to record the number of actual faults or malfunctions of that particular component since the last recording period, and a current rate displaying the rate or ratio of actual failures to the total number of opportunities to fail. A column called "previous rates" includes the history of failure ratios for the identified component. A column called "the history of failure" indicates the trend toward total failure of a particular component such as a sensor or could indicate an adverse trend of components such as belts or pulleys. With reference to the present invention, the CRUM such as 11 or 13 associated with a module may include all or part of such a multi-column list of failure-related codes; or, alternately, the memory within the machine itself could retain these columns of codes, and then derive particular fault codes for transference to the CRUM 11, 13. The advantage of retaining all of the columns in the memory of the CRUM is that advanced techniques of failure analysis can be performed during a remanufacturing process, regardless of the relative sophistication of the diagnostic software within the machine itself. Further, by taking the raw column-related failure codes from the CRUM 11, 13 itself, the various algorithms for determining failures can be "fine-tuned" by the remanufacturer looking at a real population of modules passing through the manufacturing process. Evolutionary adjustments in the remanufacturing process can thus take place on the modules regardless of the diagnostic software which is installed in various machines in the field.

While the invention has been described with reference to the structure disclosed, it is not confined to the details set forth, but is intended to cover such modifications or changes as may come within the scope of the following claims.

What is claimed is:

1. A method of processing a unit installable in a printing apparatus, the unit including a first part, a second part, and a memory, comprising the steps of:

reading out from the memory a set of codes, a first code relating to at least one of a plurality of fault conditions, and a second code relating to an accumulated use of the unit;

entering the first code and the second code in a first algorithm;

deciding to replace the first part in the unit, based on the first algorithm;

entering the first code and the second code in a second algorithm: and deciding to replace the second Dart in the unit, based on the second algorithm.

2. The method of claim 1, the set of codes including a third code relating to at least one of a plurality of fault conditions, and further comprising the steps of entering the first code and the third code in a second algorithm; and deciding to replace the first part of the unit based on the second algorithm.

3. The method of claim 1, wherein one of the fault conditions relates to arcing of a charging device.

4. The method of claim 1, wherein one of the fault conditions relates to the intensity of a laser exposing a photosensitive member in the module.

5. The method of claim 1, wherein one of the fault conditions relates to a bias placed on a part in the unit, as determined by a control system controlling the printing apparatus.

6. The method of claim 1, wherein the fault condition relates to a detected temperature within the unit.

7. The method of claim 1, wherein the fault condition relates to the output of a seam profile relative to a seam in a rotating photosensitive member.

8. The method of claim 1, wherein the fault condition relates to a torque on a fuser-cleaning web being of a predetermined relationship to a predetermined range.

9. The method of claim 1, wherein the second code relates to an amount of accumulated use of the unit since the first part was last replaced.

10. A method of processing a unit installable in a printing apparatus, the unit including a first part, a second part, and a memory, comprising the step of:

providing in the memory a first code and a second code, the first code relating to an accumulated use of the first part, and the second code relating to an accumulated use of the second part;

in a remanufacturing process, replacing the first part and not replacing the second part; and in said remanufacturing process, resetting the first code and not resetting the second code.

11. The method of claim 10, wherein the first part is a photoreceptor.

12. The method of claim 10, wherein the first part is a device used in charging a photoreceptor.

13. The method of claim 10, wherein the first part is a device used in cleaning a photoreceptor.

14. The method of claim 10, wherein the first part is a fuser roll.

15. The method of claim 10, Wherein the first part is a device used in cleaning a fuser roll.

16. The method of claim 10, further comprising the step of:

in said remanufatcuring process, reading from the memory the first code and the second code.

17. The method of claim 10, further comprising the step of:

in said remanufatcuring process, reading from the memory the first code and the second code.

* * * * *